US008486329B2

(12) United States Patent
Shikai et al.

(10) Patent No.: US 8,486,329 B2
(45) Date of Patent: Jul. 16, 2013

(54) PROCESS FOR PRODUCTION OF SEMISOLIDIFIED SLURRY OF IRON-BASE ALLOY AND PROCESS FOR PRODUCTION OF CAST IRON CASTINGS BY USING A SEMISOLIDIFIED SLURRY

(75) Inventors: Syuichi Shikai, Hyogo (JP); Yasushi Fujinaga, Hyogo (JP); Minoru Sasaki, Hyogo (JP); Toshio Ohkado, Hyogo (JP); Susumu Nishikawa, Hyogo (JP)

(73) Assignee: Kogi Corporation, Hyogo (JP)

( * ) Notice: Subject to any disclaimer, the term of this patent is extended or adjusted under 35 U.S.C. 154(b) by 58 days.

(21) Appl. No.: 13/256,014

(22) PCT Filed: Mar. 12, 2009

(86) PCT No.: PCT/JP2009/054743

§ 371 (c)(1),
(2), (4) Date: Sep. 12, 2011

(87) PCT Pub. No.: WO2010/103641

PCT Pub. Date: Sep. 16, 2010

(65) Prior Publication Data

US 2012/0003115 A1 Jan. 5, 2012

(51) Int. Cl.

| | |
|---|---|
| ***C22C 33/08*** | (2006.01) |
| ***C22C 33/10*** | (2006.01) |
| ***C22C 37/04*** | (2006.01) |
| ***B22D 25/06*** | (2006.01) |

(52) U.S. Cl.
USPC ..... 420/18; 420/26; 420/27; 420/29; 148/543; 75/433; 164/55.1

(58) Field of Classification Search
USPC ... 148/543, 321–324, 902; 420/9–33; 75/433; 164/55.1
See application file for complete search history.

(56) References Cited

U.S. PATENT DOCUMENTS

| | | | | |
|---|---|---|---|---|
| 2,841,489 | A * | 7/1958 | Morrogh | 420/26 |
| 3,058,822 | A * | 10/1962 | Volianik | 75/531 |
| 3,843,356 | A * | 10/1974 | Renschen et al. | 420/441 |
| 2004/0173337 | A1 * | 9/2004 | Yurko et al. | 164/133 |
| 2004/0238150 | A1 * | 12/2004 | Adachi et al. | 164/113 |

FOREIGN PATENT DOCUMENTS

| | | | |
|---|---|---|---|
| JP | 2004292932 | A | 10/2004 |
| JP | 2006122971 | A | 5/2006 |
| WO | 2008096411 | A1 | 8/2008 |

* cited by examiner

*Primary Examiner* — Deborah Yee
(74) *Attorney, Agent, or Firm* — Bacon & Thomas, PLLC

(57) ABSTRACT

A process for the production of a semi-solidified iron alloy slurry having a crystallized solid phase and a residual liquid phase, wherein a material having a hypoeutectic cast iron composition is used, and an additive agent having a boiling point that is lower than at least a crystallization initiation temperature of primary crystals of the material is added to a melt of the material when the melt temperature is within a specific temperature range of not lower than the crystallization initiation temperature of the primary crystals and not greater than a temperature that is 50° C. higher than the crystallization initiation temperature, to thereby simultaneously conduct the stirring of the melt by the boiling of the additive agent and the cooling of the melt to a temperature falling within a semi-solidification temperature range thereof.

11 Claims, 9 Drawing Sheets

100 μm

PROCESS FOR PRODUCTION OF SEMISOLIDIFIED SLURRY OF IRON-BASE ALLOY AND PROCESS FOR PRODUCTION OF CAST IRON CASTINGS BY USING A SEMISOLIDIFIED SLURRY

TECHNICAL FIELD

The present invention relates to a process for producing a semi-solidified slurry of an iron alloy, a process for producing cast iron castings by using the process, and cast iron castings.

BACKGROUND ART

In the case where a metallic material is cooled from a molten state (i.e. a melt) to attain a solid-liquid coexisting state, this may be referred to as the semi-solidified slurry state of the metal.

Processes for producing such semi-solidified metallic slurries have conventionally been disclosed, which include: a process for producing a semi-solidified slurry by applying mechanical stirring during a cooling process (Patent Document 1); a process for producing a semi-solidified slurry by using an inclined cooling plate (Patent Document 2); and a process for producing a semi-solidified slurry by applying electromagnetic stirring (Patent Document 3).

Patent Document 1: Japanese Patent Application Laid-Open No. 6-297097

Patent Document 2: Japanese Patent Application Laid-Open No. 10-34307

Patent Document 3: Japanese Patent Application Laid-Open No. 2005-88083

DISCLOSURE OF THE INVENTION

Problems to be Solved by the Invention

With the process applying mechanical stirring as disclosed in Patent Document 1 above, however, in the case of stirring a melt of a high melting point material such as a cast iron, a stirrer may deteriorate easily, or its components may melt in. There is essentially no stirrer that can be put into practical use.

With the process using the inclined cooling plate as in Patent Document 2 above, in the case of using the same for the production of a semi-solidified slurry of a high melting point material such as a cast iron, the inclined cooling plate may deteriorate easily. Moreover, a molten metal coming into contact with the inclined cooling plate may solidify and adhere thereto. This technique requires delicate temperature control as well as operation control for the inclined cooling plate.

Furthermore, with the process applying electromagnetic stirring as in Patent Document 3 above, a large-scale facility is required. In addition, the viscosity of the melt needs to be kept low in order to realize substantial stirring, so that the resultant slurry will have a low solid fraction of about 20% or less. With the slurry having such a low solid fraction, even if the same is molded by die casting or the like, it will suffer many defects including blow holes.

On the other hand, in the case of producing cast iron castings using a semi-solidified slurry of an iron alloy, particularly a cast iron, the resultant structure may often be a eutectic structure of iron and cementite. Even if this cementite is subjected to tempering heat treatment for graphitization, the tempered graphite would likely be in massive form, which is inferior in terms of mechanical properties such as strength and elongation to a structure having spheroidal graphite. In the case of a thick casting, the cast structure will not be a perfect eutectic structure of iron and cementite. Graphite will crystallize at the center in thickness, and it is eutectic graphite, leading to degradation in strength of the casting.

In view of the foregoing, an object of the present invention is to solve the conventional problems as described above and to provide a process for producing a semi-solidified slurry of an iron alloy, particularly a cast iron, according to which a favorable semi-solidified slurry can be produced without performing mechanical stirring with a stirrer, without performing electromagnetic stirring which requires a special facility, and without using contact cooling means like the inclined cooling plate. Another object of the present invention is to provide a process for producing cast iron castings by using the semi-solidified slurry producing process, and cast iron castings.

Means for Solving the Problems

To achieve the above objects, the present inventors carried out various experiments and examinations, and as a result, they have found that the temperature during the process of solidification of a melt can be controlled appropriately without the need of mechanical or electromagnetic stirring means, and they have finally achieved the present invention by enabling the production of a semi-solidified slurry of an arbitrary solid fraction.

A process for producing a semi-solidified slurry of an iron alloy according to the present invention has a first feature that it is a process for producing a semi-solidified slurry of an iron alloy by cooling an iron alloy melt in a semi-solidified slurry producing vessel to obtain a semi-solidified slurry having a crystallized solid phase and a residual liquid phase, the process including: using a material having a hypoeutectic cast iron composition; controlling a temperature of a melt of the material to fall within a specific temperature range of not lower than a crystallization initiation temperature of primary crystals in the composition and not greater than a temperature that is 50° C. higher than the crystallization initiation temperature; and adding, to the melt that is in the specific temperature range, an additive agent having a boiling point that is lower than at least the crystallization initiation temperature of the primary crystals, to thereby simultaneously conduct the stirring of the melt by the boiling of the additive agent within the melt and the cooling of the melt to a temperature falling within a semi-solidification temperature range thereof.

The process for producing a semi-solidified slurry of an iron alloy of the present invention has, in addition to the first feature described above, a second feature that a part or a whole of the additive agent is composed of a graphite spheroidizing agent for a cast iron.

The process for producing a semi-solidified slurry of an iron alloy of the present invention has, in addition to the second feature described above, a third feature that the graphite spheroidizing agent contains Mg.

The process for producing a semi-solidified slurry of an iron alloy of the present invention has, in addition to any of the first through third features described above, a fourth feature that the additive agent contains one or both of Ni and Cu in an amount of 85 wt % or more in total.

A process for producing cast iron castings according to the present invention has a fifth feature that it includes: using a semi-solidified slurry obtained by the semi-solidified slurry producing process having any of the first through fourth features described above; and press-feeding the semi-solidified slurry into a mold cavity for molding.

The process for producing cast iron castings of the present invention has, in addition to the fifth feature described above, a sixth feature that the molding is followed by graphitizing heat treatment.

A cast iron casting according to the present invention has a seventh feature that it is obtained by the process for producing cast iron castings having the fifth or sixth feature described above.

The cast iron casting of the present invention has, in addition to the seventh feature described above, an eighth feature that it has a structure including granular crystals and spheroidal or massive graphite.

The cast iron casting of the present invention has, in addition to the eighth feature described above, a ninth feature that it contains Mg in an amount of 0.004 to 0.1 wt %.

Effects of the Invention

According to the process for producing a semi-solidified slurry of an iron alloy recited in claim 1, to a melt the temperature of which is controlled to fall within a specific temperature range of not lower than the crystallization initiation temperature and not greater than a temperature that is 50° C. higher than the crystallization initiation temperature, an additive agent having a boiling point lower than the specific temperature range is added, so that the melt is lowered in temperature to fall within the semi-solidification temperature range while being stirred by the boiling of the additive agent in the melt. As the melt is stirred, the entire melt is equalized in temperature, whereby the temperature gradient within the melt is eliminated. This ensures that, when the melt reaches the primary-crystal crystallization temperature, the primary crystals are developed in granular form, rather than in dendritic form (dendrites).

According to the process for producing a semi-solidified slurry of an iron alloy recited in claim 2, in addition to the above-described effects obtained by the configuration recited in claim 1, a part or a whole of the additive agent is composed of a graphite spheroidizing agent for a cast iron. Therefore, when the resultant semi-solidified slurry is used to produce cast iron castings, a structure having spheroidized graphite therein is able to be obtained. As a result, it is possible to obtain a cast iron casting which has not only the granulated cast iron structure as described above, but also spheroidized graphite, thereby exhibiting excellent mechanical properties.

According to the process for producing a semi-solidified slurry of an iron alloy recited in claim 3, in addition to the above-described effects obtained by the configuration recited in claim 2, the graphite spheroidizing agent contains Mg. This further promotes granulation of the primary crystals crystallized, so that a semi-solidified slurry more suitable for casting is able to be obtained.

According to the process for producing a semi-solidified slurry of an iron alloy recited in claim 4, in addition to the above-described effects obtained by the configuration recited in any of claims 1 to 3, the additive agent contains one or both of Ni and Cu in an amount of 85 wt % or more in total. This allows the specific gravity of the additive agent as a whole to be greater than that of the melt, thereby permitting the additive to sink to the bottom of the melt and boil from that state. This ensures more stable stirring of the entire melt, permitting the melt temperature to be unified at around the primary-crystal crystallization temperature, so that crystallization of favorable granular primary crystals is expected. As a result, it is possible to obtain a more favorable semi-solidified slurry.

Further, in the case where the additive agent contains the graphite spheroidizing agent, the yield of the graphite spheroidizing agent in the melt is improved. This can further promote spheroidization of graphite in the cast iron castings produced by using the obtained semi-solidified slurry. The effects can be obtained even if the added amount of the graphite spheroidizing agent is reduced.

According to the process for producing cast iron castings recited in claim 5, the semi-solidified slurry obtained by the semi-solidified slurry producing process having the feature recited in any of claims 1 to 4 described above is used, and this semi-solidified slurry is press-fed into a mold cavity for molding. That is, the semi-solidified slurry having the granulated crystal structure is used as a starting material, which is press-fed into the mold cavity for casting. The resultant cast iron casting has a structure rich in granular crystals, so that a cast iron casting having good mechanical properties is able to be produced. In the case where the semi-solidified slurry used as a starting material is the one obtained by using the additive agent which is partly or entirely the graphite spheroidizing agent, the resultant cast iron casting has a structure which is rich in spheroidal graphite besides the granular crystals. Accordingly, it is possible to obtain a cast iron casting having sufficiently favorable mechanical properties.

As the semi-solidified slurry is press-fed into the mold cavity for molding, it is of course possible to obtain a casting which has small grains and is closely packed, and exhibits good mechanical properties.

According to the process for producing cast iron castings recited in claim 6, in addition to the above-described effects obtained by the configuration recited in claim 5, the graphitizing heat treatment is performed following the molding. With the graphitizing heat treatment, graphite and cementite included in the as-cast cast iron casting are modified, so that the resultant cast iron casting has favorable graphite precipitated therein. Particularly in the case of the cast iron casting added with the graphite spheroidizing agent, the graphite can be spheroidized, and it is thus possible to obtain a cast iron casting more excellent in mechanical properties.

According to the cast iron casting recited in claim 7, it is obtained by the process for producing cast iron castings recited in claim 5 or 6. That is, the semi-solidified slurry with a granulated crystal structure is used as a starting material, which is press-fed into the mold cavity for production of the casting. The resultant cast iron casting is rich in granular crystals and the grains are small and closely packed, so that it is possible to obtain a cast iron casting exhibiting excellent mechanical properties. Further, in the case where the semi-solidified slurry used as a starting material is the one obtained by using the additive agent which is partly or entirely the graphite spheroidizing agent, the resultant cast iron casting has a structure which is rich in spheroidal graphite besides the granular crystal structure, so that it is possible to obtain a cast iron casting more excellent in mechanical properties.

According to the cast iron casting recited in claim 8, in addition to the above-described effects obtained by the configuration recited in claim 7, the structure includes granular crystals and spheroidal or massive graphite, so that it is possible to obtain a cast iron casting further excellent in mechanical properties.

According to the cast iron casting recited in claim 9, in addition to the above described effects obtained by the configuration recited in claim 8, Mg is contained in an amount of 0.004 to 0.1 wt %. Therefore, the resultant cast iron casting has much of carbon crystallized in the form of spheroidal graphite even in the as-cast state. Further, by subjecting the as-cast casting to heat treatment, it is possible to obtain a cast iron casting having a structure in which more carbon exists in the form of spheroidal graphite or massive graphite, thereby exhibiting excellent mechanical strength.

DESCRIPTION OF THE REFERENCE CHARACTERS

Figure 1:
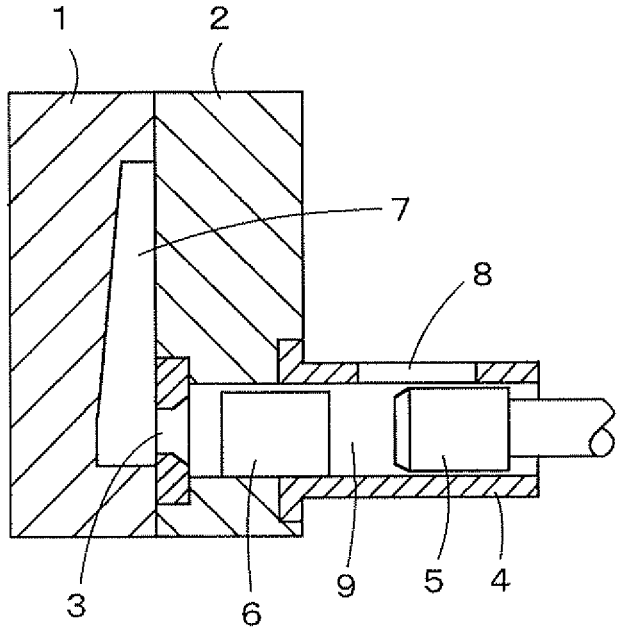
FIG. 1 is a cross-sectional view schematically illustrating a die casting machine as an example of a casting device which is used in the process for producing cast iron castings of the present invention.

1 movable mold
2 fixed mold
3 gate
4 injection sleeve
5 plunger
6 semi-solidified slurry
7 mold cavity
8 insertion opening
9 injection path

BEST MODES FOR CARRYING OUT THE INVENTION

Firstly, an embodiment of the process for producing a semi-solidified slurry of an iron alloy according to the present invention will be described.

In the process for producing a semi-solidified slurry of an iron ally of the present invention, a cast iron material having a hypoeutectic cast iron composition is used. In the case of the cast iron material with the hypoeutectic cast iron composition, as a melt of the material is cooled, when the melt temperature reaches the liquidus, solidification of the melt is started, resulting in crystallization of a solid phase, i.e. austenite. Accordingly, a solid-liquid coexisting semi-solidified slurry consisting of the crystallized solid and the residual liquid phase is produced.

In the process for producing a semi-solidified slurry of the present invention, it is configured such that an additive agent having a low boiling point is added to the melt of the hypoeutectic cast iron, while the same is being cooled, when the melt temperature is lowered to fall within a specific temperature range.

As the low boiling point additive agent is added to the melt, the additive agent is boiled within the melt to thereby stir the melt. The stirring of the melt evens up the local temperature variation within the melt, thereby permitting equalization in temperature of the melt. In the case where primary crystals are crystallized in the state where the melt is uniform in temperature, the primary crystals tend to grow in granular form, rather than in dendritic form (i.e. dendrites).

The stirring of the melt by the boiling of the additive agent, however, does not last long. The present inventors have found through experiments that the stirring effect by boiling lasts for several seconds to ten-odd seconds at longest.

This means that the timing of adding the additive agent is crucial in relation to the melt temperature. That is, it is required that primary crystals are crystallized in the state where the entire melt is uniform in temperature as the same is stirred by the boiling of the additive agent.

More specifically, it is difficult for the stirring by the boiling of the additive agent to continue several tens of seconds; it lasts from several seconds to ten-odd seconds, depending on the amount of the additive agent. This gives rise to the need to restrict the melt temperature at the time of adding the additive agent, such that the melt temperature is lowered to the semi-solidification temperature (primary-crystal crystallization temperature) within the above-described duration of the stirring.

The present inventors conducted various experiments and studies to determine in which melt temperature range the additive agent should be added to boil in the melt so as to cause primary crystals to be crystallized from the melt in granular form rather than in dendritic form. As a result, they have found that it is optimal for the additive agent to be added to the melt at the time when the melt temperature is within a temperature range of not lower than the crystallization initiation temperature of primary crystals (liquidus temperature) for the cast iron composition and not greater than a temperature that is 50° C. higher than the crystallization initiation temperature. This temperature range will be called the "specific temperature range" in the present invention.

If the melt temperature at the time of adding the additive agent is lower than the crystallization initiation temperature of primary crystals in the cast iron composition (i.e. the lower limit of the specific temperature range), primary crystals will have been crystallized in dendritic form (dendrites) before commencement of stirring, in which case the stirring will not lead to granulation of the primary crystals. On the other hand, if the melt temperature at the time of adding the additive agent exceeds the temperature that is 50° C. higher than the crystallization initiation temperature of the primary crystals (i.e. the upper limit of the specific temperature range), the melt temperature will not be lowered to the primary-crystal crystallization temperature during the stirring. The temperature variation in the melt, which was once cancelled out, will take place again at the time of initiation of crystallization of primary crystals, in which case the primary crystals cannot be granulated favorably.

In the present invention, the additive agent is added to the melt while the melt is within the specific temperature range (of not lower than the crystallization initiation temperature of primary crystals for the cast iron composition and not greater than a temperature that is 50° C. higher than the crystallization initiation temperature). This allows primary crystals to be crystallized in the state where the melt is equalized in temperature by the stirring, thereby ensuring that a semi-solidified slurry consisting of the crystallized solid having granulated crystals and the residual melt is obtained reliably and with ease. When the semi-solidified slurry having such granulated primary crystals is used for subsequent casting, or molding in a broader concept, it is possible to obtain a molded item which has an excellent structure and excellent mechanical properties.

The additive agent to be added to the melt is configured to have a boiling point that is lower than at least the crystallization initiation temperature of the primary crystals (i.e. liquidus temperature) for the composition of the melt. The additive agent preferably has a boiling point that is lower than the solidus temperature of the melt composition.

As the additive agent having a boiling point lower than the crystallization initialization temperature of primary crystals for the hypoeutectic cast iron composition, Mg, Zn, or Se, for example, may be used. Besides them, a metallic or nonmetallic solid having a boiling point lower than the above-described crystallization initiation temperature of primary crystals may be used as the additive agent as well.

As for the way of adding the additive agent, the additive agent may be thrown into the melt.

Alternatively, the additive agent may be placed in advance in a semi-solidified slurry producing vessel before the melt is poured into the vessel. All that is needed is that the melt is stirred by the boiling of the additive agent added therein.

In order to prevent the additive agent from boiling at the melt surface or the like without exerting the stirring effect, the additive agent may be enveloped with coating means such as a metal before being thrown into the melt. This can avoid the additive agent from boiling before the same is immersed into the melt.

Still alternatively, the additive agent may be mixed with another metallic solid that is heavy in specific gravity or with a nonmetallic solid so as to be thrown into the melt in an integrated manner. This ensures that the additive agent starts boiling in the state where the same is surely immersed in the melt.

For adding the additive agent, pushing means such as a pusher rod for pushing the additive agent into the melt may be used.

A part or a whole of the additive agent may be composed of a graphite spheroidizing agent for a cast iron. With the additive agent composed partly or entirely of the graphite spheroidizing agent, it is possible to obtain a semi-solidified slurry having crystals granulated by the stirring of the melt, and moreover, when this semi-solidified slurry is used to produce a casting, a cast iron structure having graphite spheroidized in the as-cast state or after being subjected to the post heat treatment is able to be obtained. Accordingly, it is possible to obtain a cast iron casting which is further excellent in mechanical and chemical properties.

As the graphite spheroidizing agent, any of Mg-based, Ca-based, Ce-based, or other graphite spheroidizing agents known in the art may be used. The Mg-based graphite spheroidizing agents include, for example, pure Mg, Cu—Mg alloy, Ni—Mg alloy, Fe—Si—Mg alloy, and Ni—Si—Mg alloy. As the Ca-based graphite spheroidizing agent, Ca—Si—Mg alloy, Fe—Ca—Si alloy, or Ca—Si alloy may be used. As the Ce-based graphite spheroidizing alloy, misch metal or the like may be used.

In the case where the additive agent is to be composed entirely of a graphite spheroidizing agent, it is required that at least a part of the graphite spheroidizing agent includes a low boiling material, i.e. a material having a boiling point that is lower than the crystallization initiation temperature of primary crystals (i.e. liquidus temperature) for the composition of the melt. While the low boiling material for use as the graphite spheroidizing agent may be Mg (with the boiling point of 1090° C.) or Ce (with the boiling point of 671° C.), it can be said that Mg is preferable in consideration of cost and others.

The graphite spheroidizing agent containing Mg is preferable because the melt stirring effect by the boiling of Mg is expected. It is preferable that the graphite spheroidizing agent also contains a nonmetal or a metal with a high specific gravity. The metal of high specific gravity contained in the graphite spheroidizing agent permits the graphite spheroidizing agent to be readily immersed into the melt.

The amount of Mg to be added to the melt as the graphite spheroidizing agent is preferably from 0.1 wt % to 0.5 wt %. If it is less than 0.1 wt %, the reaction time will be less than several seconds, which is too short for the melt to be equalized in temperature and kept in the uniform temperature state. On the other hand, if it exceeds 0.5 wt %©, the reaction will be unfavorably too intense. In the case of adding Mg in the above-described amount of 0.1 to 0.5 wt %, it is preferable that the contained amount thereof is from 0.004 wt % to 0.1 wt % in the as-cast state of the cast iron casting, as will be described later. Mg contained in an amount of 0.004 to 0.1 wt % permits spheroidization of the graphite being crystallized. It also allows the massive graphite that precipitates in the graphitizing heat treatment to approach the spheroidal form.

The metals having a specific gravity greater than that of Fe include Cu and Ni. When one or both of Cu and Ni are contained in the graphite spheroidizing agent in an amount of 85 wt % or more, the specific gravity of the graphite spheroidizing agent becomes greater than that of the cast iron melt, so that the graphite spheroidizing agent sinks into the melt. This can further enhance the melt stirring effect by the graphite spheroidizing agent, and enhance the graphite spheroidizing effect as well. Moreover, it leads to an improved yield of the spheroidizing element such as Mg being contained.

As described above, it can be said that, when the graphite spheroidizing agent is used as a part or a whole of the additive agent, the graphite spheroidizing agent containing Cu and Ni besides Mg is preferable.

The graphite spheroidizing agent containing Mg, Cu, and Ni may be configured to contain Mg, Cu, and Ni as Cu—Mg alloy, Ni—Mg alloy, and Cu—Ni—Mg alloy, for example. It is noted that one or both of Cu and Ni may be contained in an amount of 85 wt % or more in the additive agent including the graphite spheroidizing agent.

The degree and duration of the boiling of the melt by addition of the additive agent may be controlled for example by adjusting the amount of the additive agent and/or the pressure inside the semi-solidified slurry producing vessel.

The semi-solidified slurry producing vessel is a vessel for receiving the melt from a ladle or the like and for allowing the melt to be cooled therein until it becomes a semi-solidified slurry. The semi-solidified slurry producing vessel is preferably provided with cooling-rate adjusting means for controlling the cooling rate of the melt flown therein.

The cooling-rate adjusting means controls the time required for the melt temperature to be lowered from the upper limit of the specific temperature range (i.e. the temperature 50° C. higher than the crystallization initiation temperature of primary crystals) to the lower limit of the specific temperature range (i.e. the crystallization initiation temperature of the primary crystals). This ensures that crystallization of the primary crystals from the melt is started while the entire melt is uniform in temperature as the melt is stirred by the additive agent added therein.

For example, in the case where it takes ten seconds for the melt to be equalized in temperature as the same is stirred by the additive agent added therein, then the cooling-rate adjusting means may adjust the cooling rate (temperature lowering rate) such that the temperature is decreased (by 50° C., for example) from the temperature at the time of adding the additive agent (for example, the upper limit of the specific temperature range) to the lower limit thereof within ten seconds or less.

Specifically, the cooling-rate adjusting means may be configured with pre-heating means and cooling promoting means, so as to adjust the cooling rate of the melt within the semi-solidified slurry producing vessel to a desired rate.

When taking the semi-solidified slurry out of the semi-solidified slurry producing vessel, the pre-heating means made up of high-frequency induction heating means, for example, may be used to quickly heat the semi-solidified slurry producing vessel so as to cause only the portion of the semi-solidified slurry that is in contact with the producing vessel to be increased in temperature, thereby facilitating taking out thereof. This also prevents the semi-solidified slurry from suffering temperature variation, thereby ensuring that the same is taken out at a desired solid fraction.

Further, it is controlled such that the melt is poured into the semi-solidified slurry producing vessel at the time when the melt temperature falls within the above-described specific temperature range. However, it is of course possible for the melt to be poured into the semi-solidified slurry producing vessel when the melt temperature is greater than the specific temperature range. In this case, the melt is cooled within the semi-solidified slurry producing vessel to a temperature falling within the specific temperature range, when the additive agent is added thereto for the purpose of stirring the melt.

Work procedure in the above-described process for producing a semi-solidified slurry of an iron alloy is as follows.

As a raw material for producing a semi-solidified slurry, a material having a hypoeutectic cast iron composition is used. The raw material is melted in a melting furnace to obtain a melt having a prescribed hypoeutectic cast iron composition.

The melt melted in the melting furnace is relayed by a ladle or other intermediate vessel so as to be poured into the semi-solidified slurry producing vessel in an appropriate amount at a time. The melt poured into the semi-solidified slurry producing vessel is cooled therein to obtain a semi-solidified slurry with primary crystals crystallized. The additive agent is added when the melt temperature falls within the specific temperature range. Specifically, the additive agent is added at the time when the melt whose temperature falls within the specific temperature range is poured into the semi-solidified slurry producing vessel, or it is added at the time when the melt that has been poured into the semi-solidified slurry producing vessel is lowered in temperature to the specific temperature range. The melt is cooled while being stirred by the boiling of the additive agent added therein to attain a temperature-equalized state, when it reaches the crystallization initiation temperature of primary crystals. As a result, the primary crystals are crystallized in granular form, rather than in dendritic form, whereby a semi-solidified slurry consisting of the granular primary crystals and the residual liquid phase is produced. The semi-solidified slurry as it is taken out of the semi-solidified slurry producing vessel, so as to be subjected to a molding process such as casting.

Hereinafter, the process for producing cast iron castings according to the present invention will be described.

In the process for producing cast iron castings of the present invention, the semi-solidified slurry obtained by the semi-solidified slurry producing process of the present invention described above is used, and this semi-solidified slurry is press-fed into a mold cavity for molding.

FIG. 1 schematically illustrates a die casting machine as an example of a casting device used in the process for producing cast iron castings according to the present invention. With this die casting machine, a semi-solidified slurry is press-fed into the mold cavity for molding. In this die casting machine, a movable mold 1 and a fixed mold 2 create a mold cavity 7. An injection sleeve 4 is attached to the fixed mold 2. The injection sleeve 4 has an injection path 9 formed therein, to allow a plunger 5 to move forward and backward in the injection path 9. An insertion opening 8 is provided in a portion of the injection sleeve 4, to allow a semi-solidified slurry 6 to be introduced therefrom.

The semi-solidified slurry 6 of the present invention obtained in the semi-solidified slurry producing vessel is introduced from the insertion opening 8 into the injection sleeve 4, and press-fed by the plunger 5 through the injection path 9 and from a gate 3 into the mold cavity 7, for casting. When the casting inside the mold cavity 7 is completed, the movable mold 1 is moved away from the fixed mold 2, to take out a cast iron casting.

In the process for producing cast iron castings of the present invention, the semi-solidified slurry 6 is press-fed into the mold cavity 7 to cause it to solidify under pressure. The way of press-feeding the slurry into the mold is not restricted to the above-described way of using the die casting machine.

According to the process for producing cast iron castings of the present invention, the semi-solidified slurry consisting of the melt and the primary crystals in granular form that was obtained by the semi-solidified slurry producing process of the present invention is press-fed into the mold cavity for molding. The resultant cast iron casting has a structure which is free of defects and dendrites and is closely packed, whereby a cast iron casting excellent in mechanical and chemical properties is able to be obtained.

Further, in the process for producing cast iron castings of the present invention, the cast iron casting formed by casting may be subjected to graphitizing heat treatment as the post-treatment, rather than being left as cast. The graphitizing heat treatment can improve the structure of the as-cast cast iron casting, permitting graphitization of the crystallized or precipitated carbon as well as modification in shape of the graphite. As a result, it is possible to obtain a cast iron casting which has more excellent mechanical and chemical properties.

In the case of a cast iron casting obtained from the semi-solidified slurry that has been produced through treatment using the graphite spheroidizing agent in advance, when the cast iron casting is subjected to graphitizing heat treatment as the post-treatment, the graphite within the structure becomes sufficiently spheroidal and massive. As a result, it is possible to obtain a cast iron casting more excellent in mechanical and chemical properties.

The graphitizing heat treatment may be performed for example by keeping the cast iron casting at 800° C. to 900° C. for several hours, or by repeating the same several times. The temperature for the graphitizing heat treatment is not restricted to the above-described temperature range; any heat treatment temperature known in the art may be adopted.

Hereinafter, the cast iron casting according to the present invention will be described.

The cast iron casting of the present invention is produced by the above-described process for producing cast iron castings of the present invention. The cast iron casting includes a cast iron casting in the as-cast state and a cast iron casting that has been subjected to graphitizing heat treatment as the post-treatment.

According to the cast iron casting of the present invention, the semi-solidified slurry consisting of the melt and the primary crystals having granular crystals which is obtained by the semi-solidified slurry producing process of the present invention is press-fed into the mold cavity for molding in accordance with the process for producing cast iron castings of the present invention. Therefore, the resultant cast iron casting has a structure which is free of defects and dendrites and is closely packed, thereby exerting favorable mechanical and chemical properties.

In addition, the cast iron casting of the present invention has a structure composed of granular crystals and spheroidal or massive graphite. It is thus possible to provide a cast iron casting which is actually excellent in terms of strength and elongation.

Further, the cast iron casting of the present invention contains Mg in an amount of 0.004 to 0.1 wt %. Mg contained in an amount of not less than 0.004 wt % promotes spheroidization of the graphite being crystallized, and also promotes spheroidization of the massive graphite precipitated in the graphitizing heat treatment. The contained amount of Mg of 0.1 wt % or less in the cast iron casting is sufficient. The amount exceeding 0.1 wt % is not preferable for the structure.

The contained amount of Mg in the cast iron casting is preferably from 0.01 wt % to 0.05 wt %.

EXAMPLES

A raw material having a hypoeutectic cast iron composition including 2.6 wt % C (carbon) and 1.5 wt %© Si (silicon) was used. This raw material has a liquidus temperature (crystallization initiation temperature) of 1300° C. and a solidus temperature of 1150° C. This was melted in a melting furnace, and the obtained melt was poured into a semi-solidified slurry producing vessel (inner diameter: 70 mm) which was preheated to 1000° C.

The melt of 3 kg each was prepared for Examples 1 to 11 and Comparative Examples 1 to 5.

Table 1 shows conditions for producing the semi-solidified slurries.

As the additive agent for exerting the stirring effect by boiling, three kinds of additive agents A, B, and C were prepared. The additive agents were added only to Examples 1 to 11 and Comparative Examples 3 to 5, while they were not added to Comparative Examples 1 and 2.

Table 2 shows compositions of the respective additive agents.

In each of Examples 1 to 11, the additive agent was added, in terms of the amount of Mg contained therein (in wt %), 0.1 wt %, 0.3 wt %, or 0.5 wt %.

The additive agent was added in one of the following two manners: to throw the additive agent into the semi-solidified slurry producing vessel while pouring the melt at the processing temperature into the semi-solidified slurry producing vessel ("while pouring"), or to place the additive agent in the semi-solidified slurry producing vessel (at the bottom thereof) in advance before pouring the melt at the processing temperature therein ("in vessel").

The poured melt was cooled to 1200° C. in the semi-solidified slurry producing vessel to obtain a semi-solidified slurry.

The obtained semi-solidified slurry was taken out of the vessel. A die casting machine as shown in FIG. 1 was used to press-feed the slurry into a mold cavity, whereby a cast iron casting of 100×50×20 mm was obtained.

Texture observation was performed to see the shape of primary crystals in the as-cast cast iron casting.

Texture observation was performed to see the shape of graphite in the as-cast cast iron casting.

The as-cast cast iron casting was subjected to heat treatment during which the same was kept at 900° C. for two hours. Then, texture observation was performed to see the shape of graphite in the heat-treated cast iron casting.

Results are shown in Table 3.

In Table 3, the castings having their primary crystals delivered in granular form are marked with "good", and the castings having their primary crystals delivered in dendritic form are marked with "bad". Of the castings having their primary crystals delivered in granular form ("good"), those in which the graphite was spheroidal in the as-cast state and the graphite was spheroidal plus massive after the heat treatment are marked with "excellent".

TABLE 1

| | Processing Temperature | Additive Agent | Added Amount (Mg Amount) | Adding Method |
|---|---|---|---|---|
| Example 1 | 1300° C. | A | 0.3 wt % | while pouring |
| Example 2 | 1350° C. | A | 0.1 wt % | in vessel |
| Example 3 | 1350° C. | A | 0.3 wt % | in vessel |
| Example 4 | 1350° C. | A | 0.3 wt % | while pouring |
| Example 5 | 1350° C. | A | 0.5 wt % | in vessel |
| Example 6 | 1300° C. | B | 0.1 wt % | in vessel |
| Example 7 | 1300° C. | B | 0.3 wt % | in vessel |
| Example 8 | 1300° C. | B | 0.3 wt % | while pouring |
| Example 9 | 1350° C. | B | 0.5 wt % | in vessel |
| Example 10 | 1350° C. | C | 0.1 wt % | in vessel |
| Example 11 | 1350° C. | C | 0.5 wt % | while pouring |
| Comparative Example 1 | 1300° C. | none | — | — |
| Comparative Example 2 | 1350° C. | none | — | — |
| Comparative Example 3 | 1280° C. | B | 0.3 wt % | while pouring |
| Comparative Example 4 | 1400° C. | A | 0.5 wt % | in vessel |
| Comparative Example 5 | 1400° C. | B | 0.5 wt % | in vessel |

TABLE 2

| Additive Agent | Mg | Si | Ni | Fe |
|---|---|---|---|---|
| A | 15 wt % | 45 wt % | — | balance |
| B | 15 wt % | — | 85 wt % | — |
| C | 20 wt % | — | 80 wt % | — |

TABLE 3

| | Shape of Primary Crystals | Remaining Mg Amount in Casting (wt %) | Shape of Graphite in As-Cast Casting | Shape of Graphite after Heat Treatment |
|---|---|---|---|---|
| Example 1 | granular (good) | 0.008 | eutectic | eutectic + massive |
| Example 2 | granular (good) | 0.004 | eutectic | eutectic + massive |
| Example 3 | granular (good) | 0.013 | spheroidal | spheroidal + massive (excellent) |
| Example 4 | granular (good) | 0.008 | eutectic | eutectic + massive |
| Example 5 | granular | 0.027 | spheroidal | spheroidal + massive |

TABLE 3-continued

| | Shape of Primary Crystals | Remaining Mg Amount in Casting (wt %) | Shape of Graphite in As-Cast Casting | Shape of Graphite after Heat Treatment |
|---|---|---|---|---|
| | (good) | | | (excellent) |
| Example 6 | granular (good) | 0.010 | spheroidal | spheroidal + massive (excellent) |
| Example 7 | granular (good) | 0.022 | spheroidal | spheroidal + massive (excellent) |
| Example 8 | granular (good) | 0.026 | spheroidal | spheroidal + massive (excellent) |
| Example 9 | granular (good) | 0.037 | spheroidal | spheroidal + massive (excellent) |
| Example 10 | granular (good) | 0.007 | eutectic | eutectic + massive |
| Example 11 | granular (good) | 0.021 | spheroidal | spheroidal + massive (excellent) |
| Comparative Example 1 | dendritic (bad) | 0 | eutectic | eutectic + massive |
| Comparative Example 2 | dendritic (bad) | 0 | eutectic | eutectic + massive |
| Comparative Example 3 | dendritic (bad) | 0.015 | spheroidal | spheroidal + massive |
| Comparative Example 4 | dendritic (bad) | 0.023 | spheroidal | spheroidal + massive |
| Comparative Example 5 | dendritic (bad) | 0.035 | spheroidal | spheroidal + massive |

Figure 2:
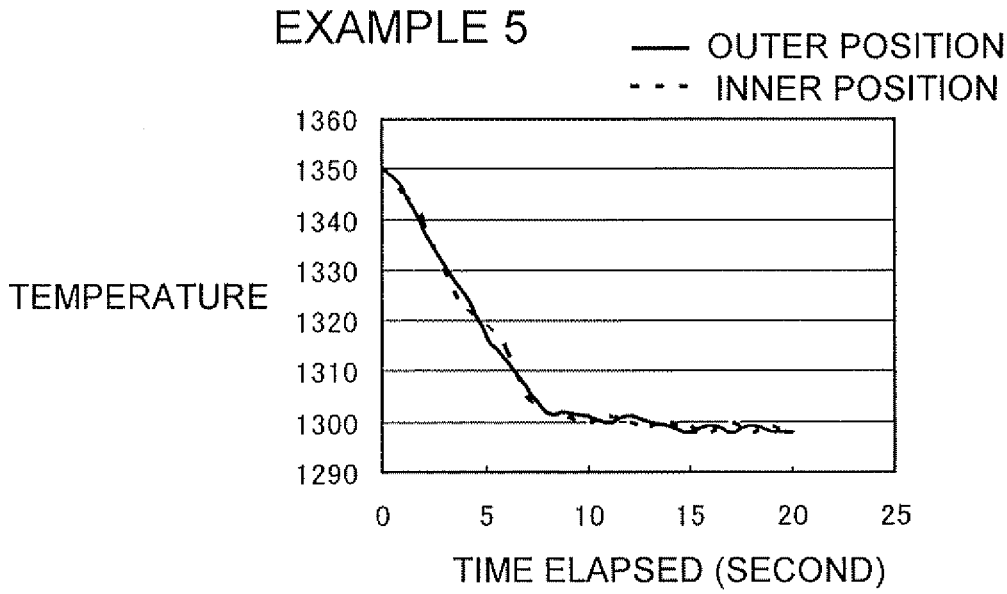
FIG. 2 shows a temperature change in a semi-solidified slurry producing vessel in Example 5 of the present invention.

FIG. 2 shows a temperature change in the semi-solidified slurry producing vessel in Example 5.

Figure 3:
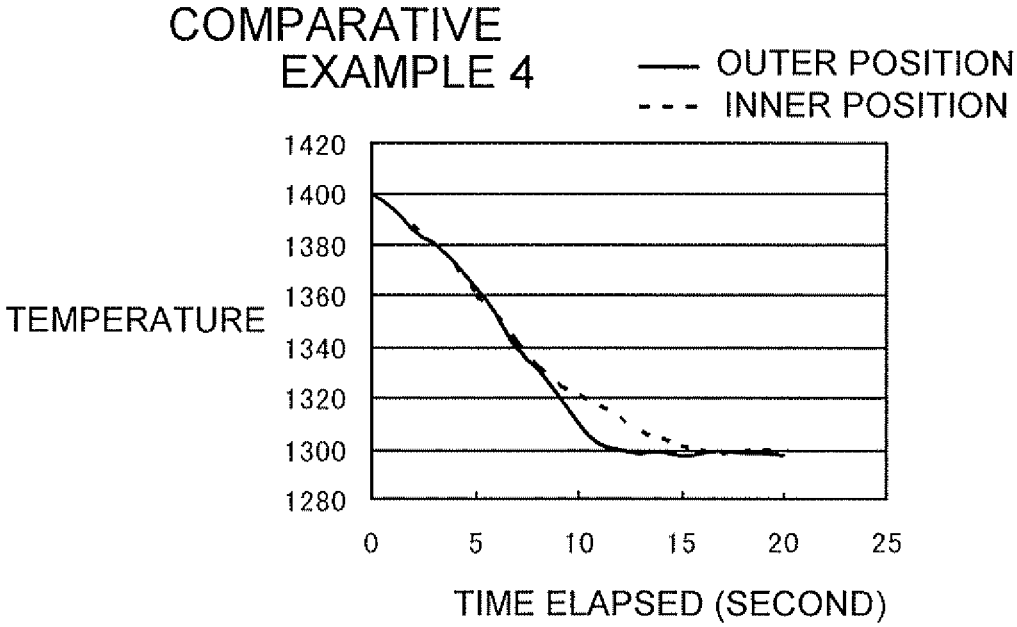
FIG. 3 shows a temperature change in the semi-solidified slurry producing vessel in Comparative Example 4 of the present invention.

FIG. 3 shows a temperature change in the semi-solidified slurry producing vessel in Comparative Example 4.

Figure 4:
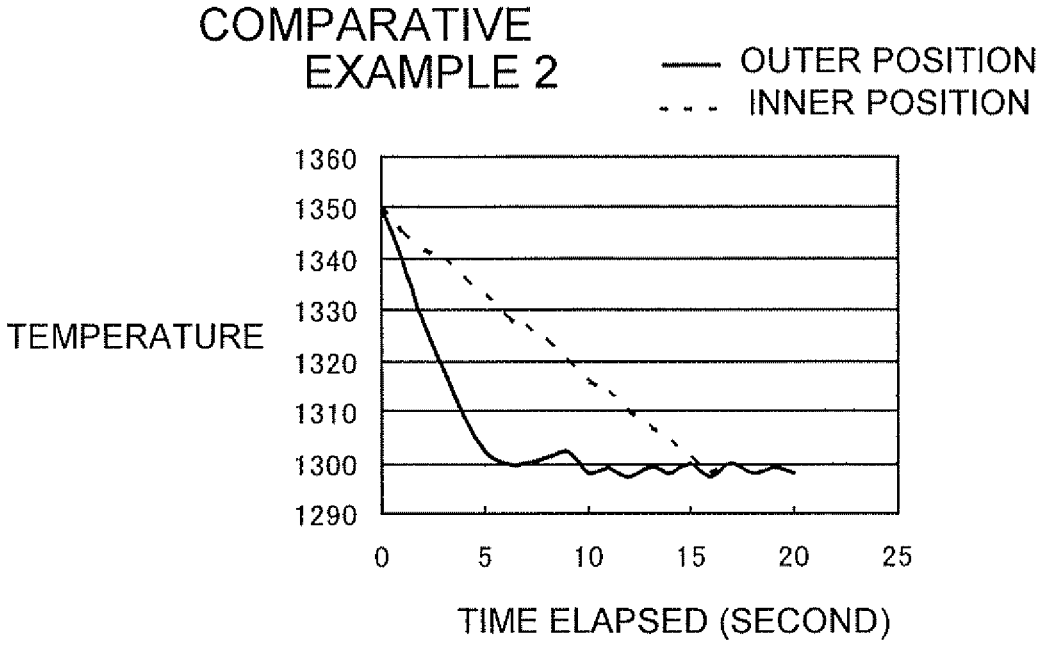
FIG. 4 shows a temperature change in the semi-solidified slurry producing vessel in Comparative Example 2 of the present invention.

FIG. 4 shows a temperature change in the semi-solidified slurry producing vessel in Comparative Example 2.

The temperature of the melt in the semi-solidified slurry producing vessel was measured at two locations of; the center position which is at the center in the lengthwise direction and also at the center in the radial direction of the vessel; and the outer position which is at the center in the lengthwise direction and 5 mm away from the inner wall in the radial direction of the vessel.

Figure 5:
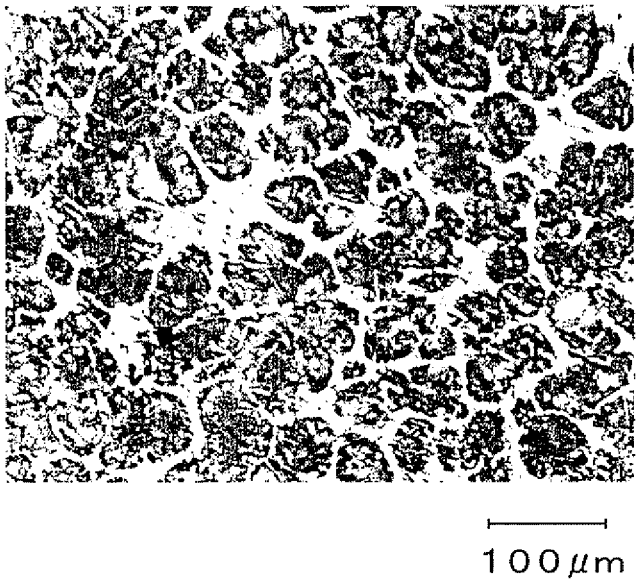
FIG. 5 is a photograph showing a structure of an as-cast casting obtained by using a semi-solidified slurry of an Example in which primary crystals grew in granular form (determined to be "good" in Table 3).

FIG. 5 shows a microstructure of the as-cast cast iron casting in an Example where primary crystals grew in granular form.

Figure 6:
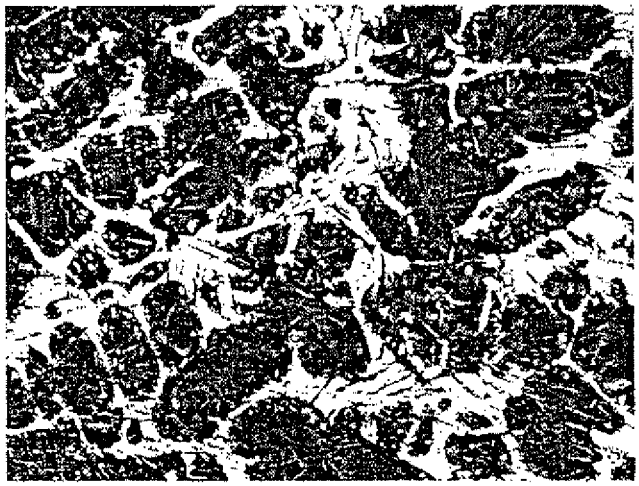
FIG. 6 is a photograph showing a structure of an as-cast casting obtained by using a semi-solidified slurry of a Comparative Example in which crystals grew in dendritic form (determined to be "bad" in Table 3).

FIG. 6 shows a microstructure of the as-cast cast iron casting in Comparative Example 1 or 2 where primary crystals grew in dendritic form.

Figure 7:
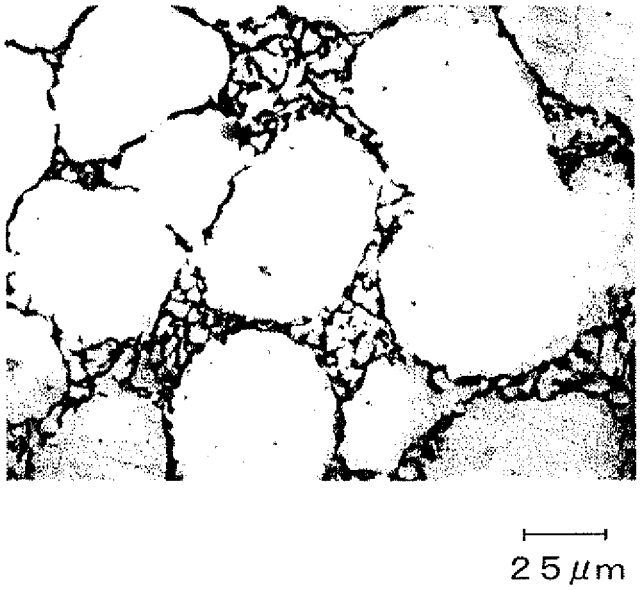
FIG. 7 is a photograph showing a eutectic graphite structure which has appeared in the as-cast casting in a Comparative Example.

FIG. 7 shows a microstructure of the as-cast cast iron casting in Comparative Example 1 or 2 where eutectic graphite was crystallized.

Figure 8:
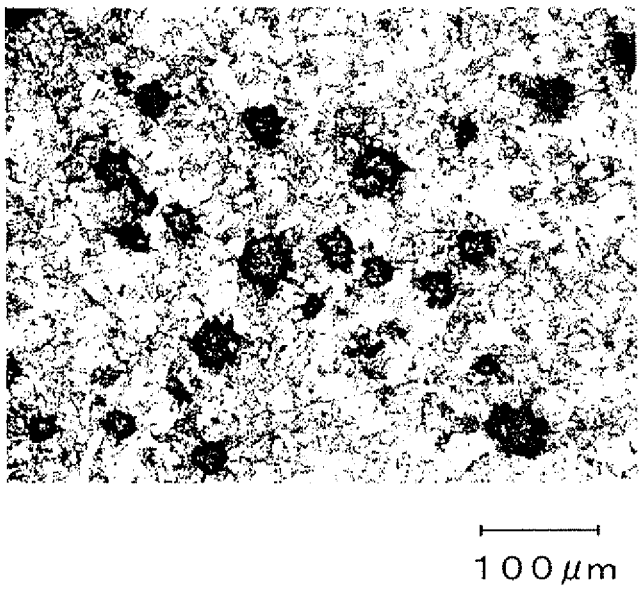
FIG. 8 is a photograph showing a structure after heat treatment of the as-cast casting in an Example in which the graphite exists as spheroidal graphite and massive graphite (determined to be "excellent" in Table 3).

FIG. 8 shows a microstructure of the heat-treated cast iron casting in an Example where "spheroidal+massive" graphite appeared.

Figure 9:
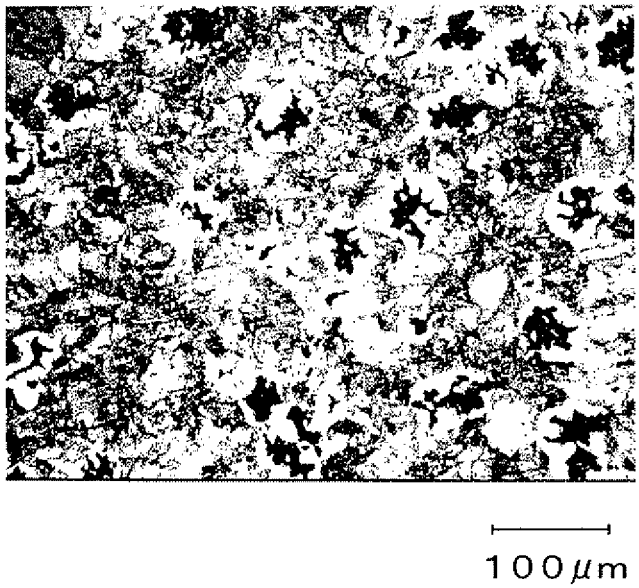
FIG. 9 is a photograph showing a state of graphite (eutectic+massive graphite) after heat treatment of a eutectic graphite structure which has appeared in the as-cast casting in a Comparative Example.

FIG. 9 shows a microstructure of the heat-treated cast iron casting in Comparative Example 1 or 2 where "eutectic+massive" graphite appeared.

As apparent from Table 3, in Examples 1 to 11 in each of which an additive agent was added within the specific temperature range from 1300° C. (crystallization initiation temperature) to 1350° C., primary crystals in granular form are able to be obtained. That is, it is possible to obtain a semi-solidified slurry with primary crystals in granular form.

In contrast, in Comparative Examples 1 and 2 in each of which no additive agent was added, primary crystals in dendritic form are crystallized because the stirring effect by boiling cannot be obtained. In Comparative Examples 3 and 4 in each of which the temperature of the melt when adding the additive agent thereto was out of the specific temperature range (from 1300° C. to 1350° C.), primary crystals in dendritic form are crystallized because the melt cannot be equalized in temperature at the time of crystallization of the primary crystals.

FIG. 2 shows a change in temperature of the melt after an additive agent is added in Example 5. The additive agent was added while the melt at 1350° C. was being poured into the semi-solidified slurry producing vessel. While the boiling and stirring by virtue of the additive agent containing Mg continued for about six seconds, within about eight seconds including the following two seconds, the temperature was lowered to about 1300° C. which is the crystallization initiation temperature of primary crystals (solidification initiation temperature). During this period, by the stirring by boiling, the melt attained a uniform temperature state where there was substantially no difference between the temperature of the melt at the center position (solid line) and that at the outer position (broken line). This permits crystallization of the primary crystals in granular form.

FIG. 3 corresponds to Comparative Example 4 where the additive agent was placed (or, added) in the semi-solidified slurry producing vessel in advance, and the melt at 1400° C. was poured therein. The stirring by boiling of the additive agent continued for about six seconds, and during about eight seconds including the following two seconds, there was substantially no difference between the temperature of the melt at the center position (solid line) and that at the outer position (broken line) (i.e. the temperature equalized state). However, as the temperature of the melt was high, it was not lowered to the solidification initiation temperature during that period, thereby causing a temperature difference between the center position and the outer position at the initiation of the solidification. This causes crystallization of the primary crystals in dendritic form.

FIG. 4 shows a temperature change in the semi-solidified slurry producing vessel in Comparative Example 2. The stirring effect by an additive agent was not able to be obtained, thereby causing a large temperature gradient between the temperature at the center position (solid line) and that at the outer position (broken line) from the time immediately after the pouring of the melt.

The heat-treated cast iron castings that were determined to be "excellent" in Table 3 among Examples 1 to 11, and the heat-treated cast iron castings that were determined to be "bad" in Comparative Examples 1 and 2 were each subjected to normalizing treatment in which the casting was kept at 900° C. for two hours and taken out of the furnace for cooling. The castings were then subjected to a tensile test. The castings of Comparative Examples 1 and 2 showed tensile strength of 400 MPa or less and elongation of 1% or less. In contrast, the castings of Examples 3, 5, 6, 7, 8, 9, and 11, which were determined to be "excellent", showed tensile strength of 850 MPa and elongation of about 5%.

As apparent from the Examples, according to the present invention, it has become possible to obtain a semi-solidified slurry having granular primary crystals suitable for later casting and other molding processes very easily as compared with the conventional semi-solid processes.

Moreover, it has become possible to prevent crystallization of eutectic graphite in a thick part and also possible to cause massive graphite after graphitizing heat treatment to approach spheroidal form, to thereby produce a material of high strength and excellent toughness.

INDUSTRIAL APPLICABILITY

The process for producing a semi-solidified slurry of an iron alloy, the process for producing cast iron castings using the process, and the cast iron castings according to the present invention have wide applications in the fields of cast iron castings and molding using cast irons.

What is claimed is:

1. A process for producing a semi-solidified slurry of an iron alloy by cooling an iron alloy melt in a semi-solidified slurry producing vessel to obtain a semi-solidified slurry having a crystallized solid phase and a residual liquid phase, the process comprising:

using a material having a hypoeutectic cast iron composition; controlling a temperature of a melt of the material to fall within a specific temperature range of not lower than a crystallization initiation temperature of primary crystals in the composition and not greater than a temperature that is 50° C. higher than the crystallization initiation temperature; and adding, to the melt that is in the specific temperature range, an additive agent having a boiling point that is lower than at least the crystallization initiation temperature of the primary crystals, to thereby simultaneously conduct the stirring of the melt by the boiling of the additive agent within the melt and the cooling of the melt to a temperature falling within a semi-solidification temperature range thereof.

2. The process for producing a semi-solidified slurry of an iron alloy according to claim 1, wherein the part or a whole of the additive agent is composed of a graphite spheroidizing agent for a cast iron.

3. The process for producing a semi-solidified slurry of an iron alloy according to claim 2, wherein the graphite spheroidizing agent contains Mg.

4. The process for producing a semi-solidified slurry of an iron alloy according to claim 1, wherein the additive agent contains one or both of Ni and Cu in an amount of 85 wt % or more in total.

5. A process for producing cast iron castings, comprising: using a semi-solidified slurry obtained by the process for producing a semi-solidified slurry according to claim 1; and press-feeding the semi-solidified slurry into a mold cavity for molding.

6. The process for producing cast iron castings according to claim 5, wherein the molding is followed by graphitizing heat treatment.

7. The process for producing a semi-solidified slurry of an iron alloy according to claim 2, wherein the additive agent contains one or both of Ni and Cu in an amount of 85 wt % or more in total.

8. The process for producing a semi-solidified slurry of an iron alloy according to claim 3, wherein the additive agent contains one or both of Ni and Cu in an amount of 85 wt % or more in total.

9. A process for producing cast iron castings, comprising: using a semi-solidified slurry obtained by the process for producing a semi-solidified slurry according to claim 2; and press-feeding the semi-solidified slurry into a mold cavity for molding.

10. A process for producing cast iron castings, comprising: using a semi-solidified slurry obtained by the process for producing a semi-solidified slurry according to claim 3; and press-feeding the semi-solidified slurry into a mold cavity for molding.

11. A process for producing cast iron castings, comprising: using a semi-solidified slurry obtained by the process for producing a semi-solidified slurry according to claim 4; and press-feeding the semi-solidified slurry into a mold cavity for molding.

* * * * *